US006778139B2

(12) United States Patent
Suzuki et al.

(10) Patent No.: US 6,778,139 B2
(45) Date of Patent: Aug. 17, 2004

(54) FLEXIBLE PRINTED ANTENNA AND APPARATUS UTILIZING THE SAME

(75) Inventors: Ryo Suzuki, Yokohama (JP); Shuhichi Endoh, Fujisawa (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/064,540

(22) Filed: Jul. 25, 2002

(65) Prior Publication Data

US 2003/0030586 A1 Feb. 13, 2003

(30) Foreign Application Priority Data

Aug. 13, 2001 (JP) ..... 2001-245229

(51) Int. Cl.[7] ..... H01Q 1/38

(52) U.S. Cl. ..... 343/700 MS; 343/790; 343/841; 343/897

(58) Field of Search ..... 343/700 MS, 702, 343/790, 792, 795, 841, 897, 846

(56) References Cited

U.S. PATENT DOCUMENTS 5,412,392 A * 5/1995 Tsunekawa ..... 343/702
5,677,698 A * 10/1997 Snowdon ..... 343/770
5,966,098 A * 10/1999 Qi et al. ..... 343/702
6,281,850 B1 * 8/2001 Klostermann ..... 343/702
6,285,328 B1 * 9/2001 Masaki et al. ..... 343/702
6,341,916 B1 * 1/2002 Nettis et al. ..... 514/164
6,377,667 B1 * 4/2002 Poulis et al. ..... 379/93.36
6,509,877 B2 * 1/2003 Masaki ..... 343/702

* cited by examiner

*Primary Examiner*—Tan Ho
(74) *Attorney, Agent, or Firm*—Carlos Munoz-Bustamante

(57) ABSTRACT

An antenna unit and a computing system utilizing the antenna unit are disclosed. The antenna is compact and can be fabricated at low cost and with high accuracy. The antenna unit comprises an antenna and a connection cable. The antenna unit is constructed by forming the antenna and the connection cable integrally on a preferably flexible insulating film using preferably the FPC (Flexible Printed Circuit) technique. The computing system comprises a body having its main operational circuits and a hinged cover having a display. The flexible printed antenna is formed integrally with its module of electric components using the FPC technique and is made to span the body and the cover. The antenna itself and the connection cable can be freely bent or folded, resulting in higher freedom in their positioning within the computer system body and cover.

12 Claims, 10 Drawing Sheets

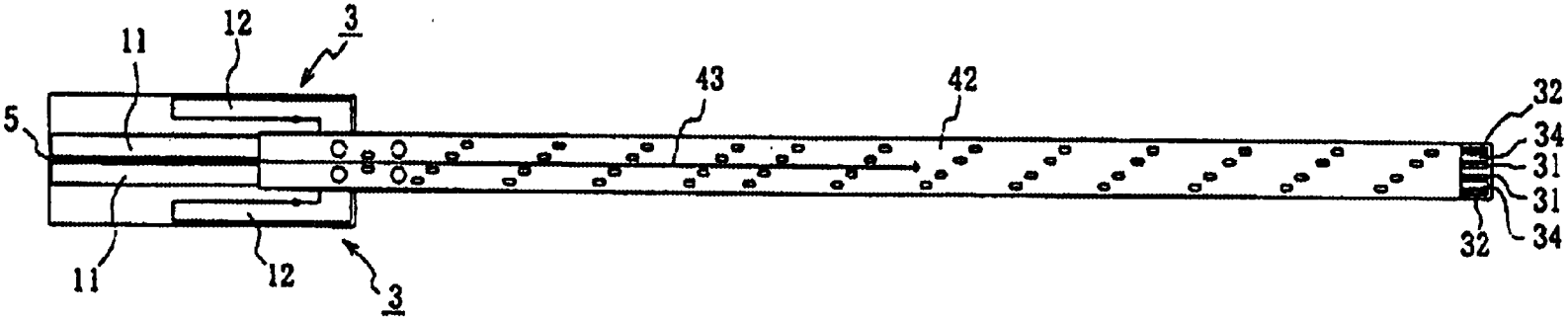
FIG. 4(A) (Frontside)
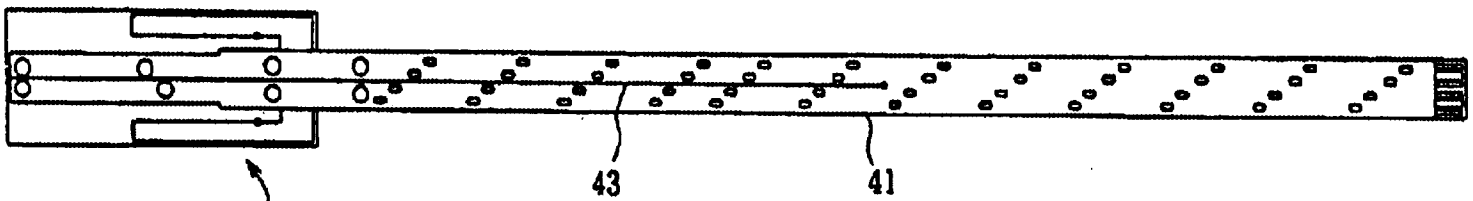
FIG. 4(B) (Backside)

51
52
53
54
61
62
64
65
21
22
24
4

FLEXIBLE PRINTED ANTENNA AND APPARATUS UTILIZING THE SAME

BACKGROUND OF INVENTION

The present invention relates to an antenna unit comprising an antenna and a connection cable, and a computer system having such a unit, particularly to an antenna unit in which an FPC (Flexible Printed Circuit) technology can be suitably used and a computer system having such a unit.

Some conventional computers, for example, notebook PCS (Personal Computers), have a built-in antenna for connection to a network or a peripheral equipment through a wireless LAN or a Bluetooth technique.

FIG. 10 shows a configuration of an example of such a conventional antenna. In an example shown in FIG. 10, an inverted "F" antenna 101 has a radio wave resonator 102, a ground 103, and a connection conductor 104 for connecting the radio wave resonator 102 and the ground 103. An antenna unit is constructed by connecting a signal line 106*a* of a coaxial cable 106 to a feeding point 105 of the radio wave resonator 102, and a shield line 106*b* of the coaxial cable 106 to the ground 103. In addition, a connector 107 is provided. Usually, the inverted "F" antenna 110 is made of several mm thick nickel silver in view of corrosion resistance. Standards IEEE 802.11b (2.45 GHz) and IEEE 802.11a (5.25 GHz) are applied to the wireless LAN, and the frequency of the Bluetooth specification is substantially same as the 2.45 GHz frequency of the IEEE 802.11b specification.

In a communication apparatus as represented by a notebook PC for its requirement to be small and light weight, the apparatus needs to be as compact as possible to minimize the space where the antenna unit is usually mounted. However, in the above described conventional antenna unit, the antenna 101 should have a certain thickness because it is fabricated by stamping from nickel silver, and, the coaxial cable 106 is desired to be as thick as possible to eliminate its signal attenuation, and so a problem arises that an antenna unit cannot be made compact.

In addition, because the frequencies used are as high as several GHz, when the signal line 106*a* of the coaxial cable 106 is connected to the feeding point 105, for example, by soldering, a problem arises that the positional accuracy for connection should be held high. Thus, even if the position of connection for the signal line 106*a* to the feeding point 105 is offset from the target position by, for example, 0.1 mm, a resonant frequency is offset by about 10 MHZ.

SUMMARY OF INVENTION

The present invention is directed to an antenna unit with a radio wave resonator and a connection cable. The antenna unit according to the present invention is integrally formed with the radio wave resonator and the connection cable on a preferably flexible insulating film utilizing preferably FPC techniques.

In the present invention, by forming the radio wave resonator and the connection cable on the flexible insulating film preferably by etching, a thin, flat and flexible antenna unit can be obtained Therefore, when the antenna unit is mounted on an LCD panel which has little free space, it requires little space for mounting because of its flatness, and can be positioned in any location if it is flexible. Further, the radio wave resonator and the connection cable can be formed at one time with high accuracy because the radio wave resonator and the connection cable can be formed by etching which is known as a process to be simple and highly accurate.

In a specific preferred example of the present invention, the connection cable comprises a signal line connected at least to a feeding point of a radio wave resonator, or a signal line connected to the feeding point of said radio wave resonator and two ground circuits provided on both sides of the signal line, and a shield material is provided between said signal line and two ground circuits on one or both of the upper and lower main surfaces of the signal line and the two ground circuits on both sides of the signal line, the shield material being a metal plated, metal powder deposited, or metal foil applied with or without unwoven or woven fabric. Specifically, when the ground circuits and the shield material are provided, a capability for preventing impact of an unnecessary electric wave, the same as for a conventional coaxial cable, can be imparted to a connection cable for the thin and flat antenna unit.

In another specific preferred example of the present invention, the material used for the insulating film is PET (Polyethylene Telephthalate) or PEN (Polyethylene Naphthalate), or LCP (Liquid Crystal Polymer) and the insulating film of PET or PEN is 5–75 mm thick. In any case, both PET and PEN can attain further compactness of the antenna unit inexpensively because they are materials with high dielectric constant and they are inexpensive. In a further specific preferred example, a pair of radio wave resonator and connection cable are formed on the insulating film and the pair of the radio wave resonator and the connection cable are notched to make them bifurcated, the electric component of the radio wave resonator is integrally formed on the insulating film, and the radio wave resonator is of a structure supporting a plurality of frequencies. In any case, the antenna unit can be fully exploited.

BRIEF DESCRIPTION OF DRAWINGS

Some of the purposes of the invention having been stated, others will appear as the description proceeds, when taken in connection with the accompanying drawings, in which:

FIGS. 4(*a*) and (*b*) are views illustrating a front and back surface in the case where the unwoven fabric shown in FIGS. 3(*a*) and (*b*) is applied to the antenna unit shown in FIG. 1;

DETAILED DESCRIPTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
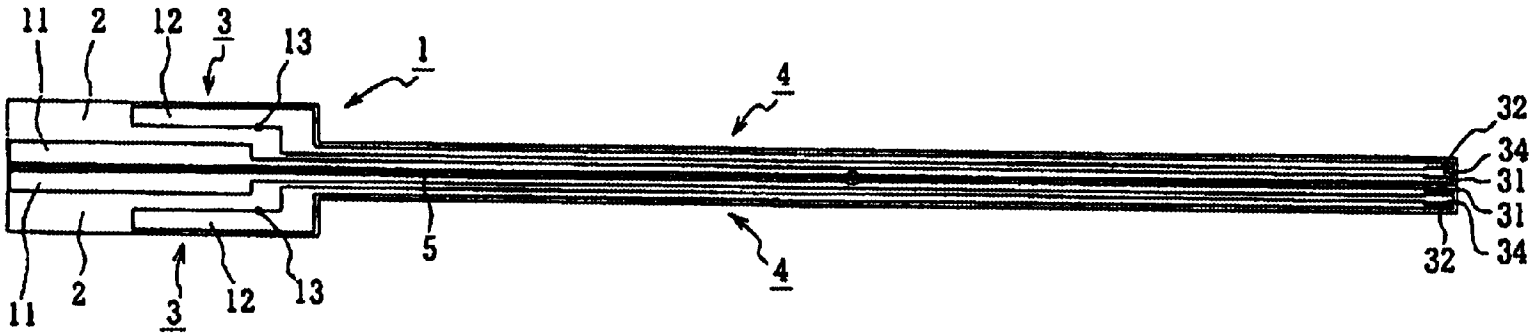
FIG. 1 is a view illustrating a configuration of an antenna unit according to the present invention.

Referring now more particularly to the accompanying drawings, FIG. 1 is a view illustrating a configuration of an example of an antenna unit according to the present invention. In the example shown in FIG. 1 an antenna unit 1 is constructed using a FPC (Flexible Printed Circuit) technique. The antenna unit 1 is made of a flexible insulating film 2, antennas 3 integrally formed on this insulating film 2, and connection cables 4 connected to the antennas 3. Because this example shows the antenna unit 1 having two integral antennas 3, in one FPC having two antennas 3 and the connection cables 4 integrated thereon, a notch 5 is provided between two antennas 3 to make them bifurcated.

Figure 2:
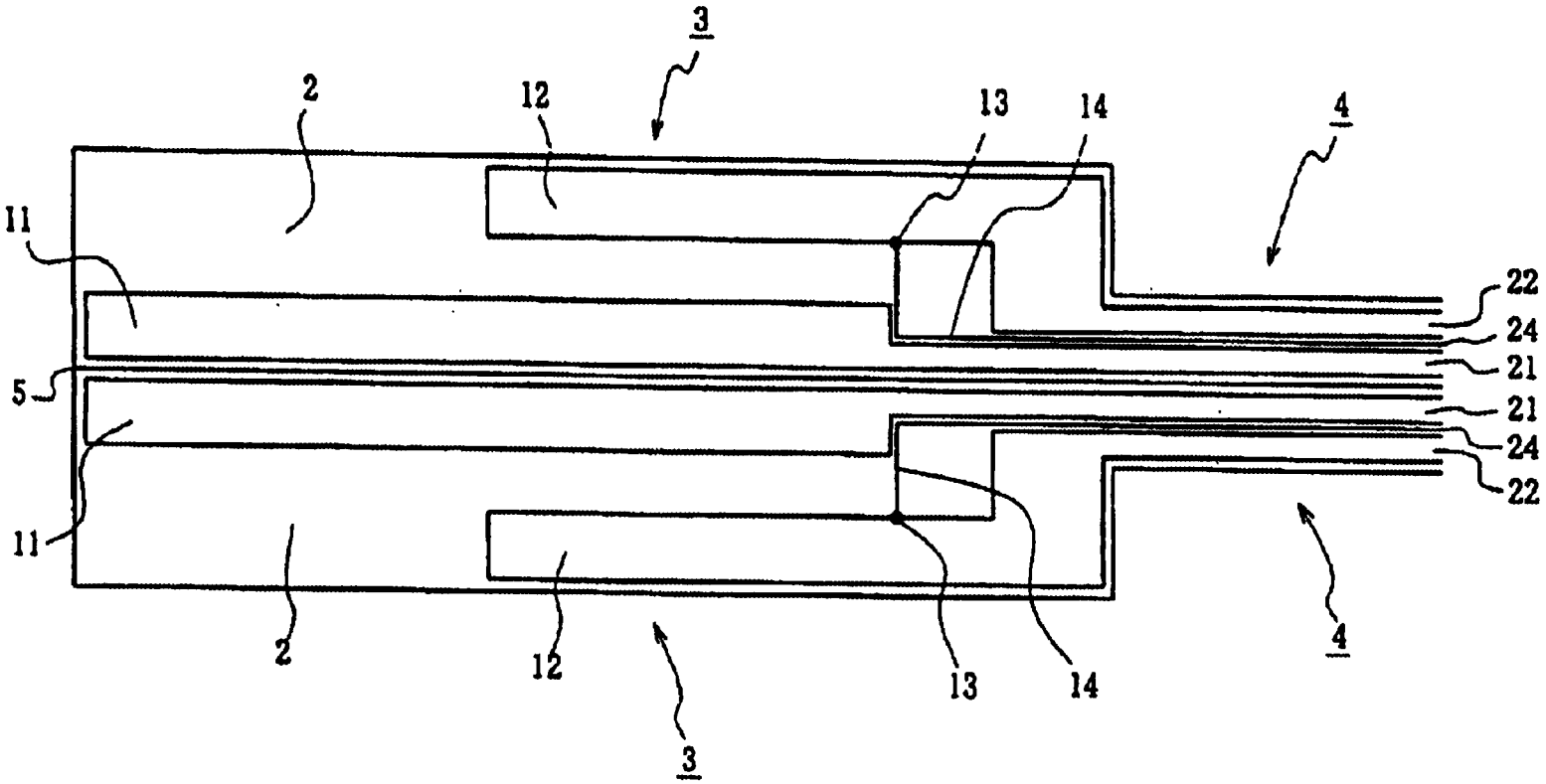
FIG. 2 is an enlarged view showing the antenna portion of the antenna unit shown in FIG. 1.

As shown in FIG. 2, in an enlarged partial view, the antenna 3 takes a shape of inverted "F", and is used to send and receive a wave of, for example, 2.45 GHz or 5.25 GHz used in IEEE 802.11b or IEEE 802.11a, standards for wireless LAN. The inverted "F" antenna 3 has a ground 11 and a radio wave resonator 12 formed on the insulating film 2. The radio wave resonator 12 is dimensioned to have a length of $\lambda/4$ or $\lambda/2^n$ (where n=1, 2, 3, . . . ) when $\lambda$ is the wavelength of a frequency targeted for sending and receiving, for example, 2.45 GHz. The radio wave resonator 12 has a feeding point 13, the feeding point 13 being connected to an end of a signal line 14 formed on the insulating film 2.

The connection cable 4 is made by extensions 21 and 22 of the ground 11 and the radio wave resonator 12 of the antenna 3 on both sides of an extension 24 of the signal line 14 on the insulating film 2. At an opposite end of the connection cable 4 to the antenna 3 side are provided terminals 31, 34 and 32 connected to the extension 21 of the ground 11, the extension 24 of the signal line 14, and the extension 22 of the radio wave resonator 12.

In the antenna unit 1 shown in FIG. 1, PET (Polyethylene Telephthalate) or a PEN (Polyethylene Naphthalate) or LCP is a preferable material to use for forming the insulating film 2, particularly the most preferable being PEN. Both PET and PEN and LCP have a high dielectric constant compared with polyimide or the like which is used usually as the insulating film 2 in such antenna applications, and have thermal resistance sufficient for practical use at a temperature of about 200° C., they are favorable. In addition, when the insulating film 2 is formed of PET or PEN or LCP, the thin and flat antenna unit 1 according to the present invention cannot exhibit its effect if the thickness of insulating film 2 exceeds 5–75 $\mu$ms and cannot be of high accuracy because of an edge factor if it is less than 5 $\mu$ms.

In the antenna unit 1 shown in FIG. 1, usually, the ground 11, the radio wave resonator 12 and the signal line 14 of the antenna 3, as well as the respective extensions 21, 22 and 24 of the ground 11, the radio wave resonator 12 and the signal line 14 in the connection cable 4 can be formed on the insulating film 2 with high accuracy and simply by forming a conductive layer over either one of two main surfaces of the insulating film 2, depositing a resist layer in a predetermined pattern on the conductive layer, and then performing a conventionally known chemical etching process.

In the antenna unit 1 shown in FIG. 1, as a conductor for the ground 11, the radio wave resonator 12 and the signal line 14 of the antenna 3 formed on the insulating film 2 and for their extensions 21, 22 and 24 in the connection cable 4 a rolled copper or a copper-plated foil is preferably used. Ni, Tin, Ag, Pb/Sn or Au (including each plating) may also be used. In addition, it is preferred to carry out an antirust treatment such as ENTEK (Trademark of SPRAYLAT Company) as a surface treatment of the antenna 3 and other circuits. In addition, it is also preferred to carry out a FLASH (gold) plating on the surface or terminal of the antenna 3 and other circuits.

Figure 10:
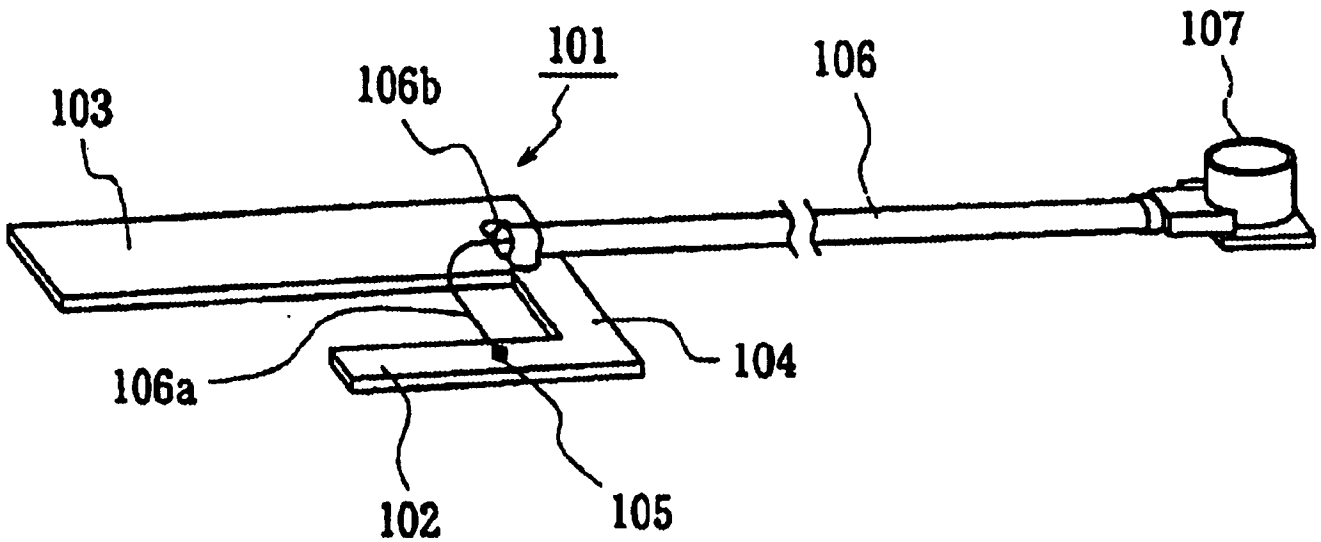
FIG. 10 Prior Art
FIG. 10 is a view illustrating an example of an example of a conventional antenna used as a diversity antenna.

Moreover, in the antenna unit 1 above described, the antenna 3 has a single radio wave resonator 12, and is configured to be able to send and receive only a single frequency, but it is possible to fabricate an antenna supporting a plurality of frequency zones as one antenna 3 by providing a plurality of radio wave resonators 12 of the antenna 3 corresponding to the frequencies. While in examples shown in FIGS. 1 and 2, the radio wave resonator 12 of the antenna 3 is formed on the insulating film, its both surfaces may be exposed as in a conventional antenna shown in FIG. 10. In addition, while an inverted "F" antenna is described as an example, antennas in various shapes such as a square-shaped slot antenna or an I-shaped rod antenna may be used to implement the present invention.

Figure 3A:
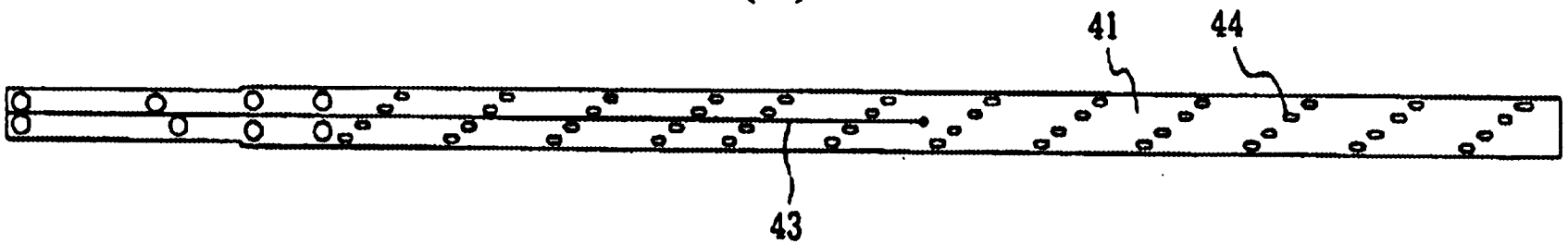
FIGS. 3(*a*) and (*b*) is a view illustrating a metal plated unwoven fabric used in a circuit requiring a shield as a preferred and example of the invention.
Figure 3B:
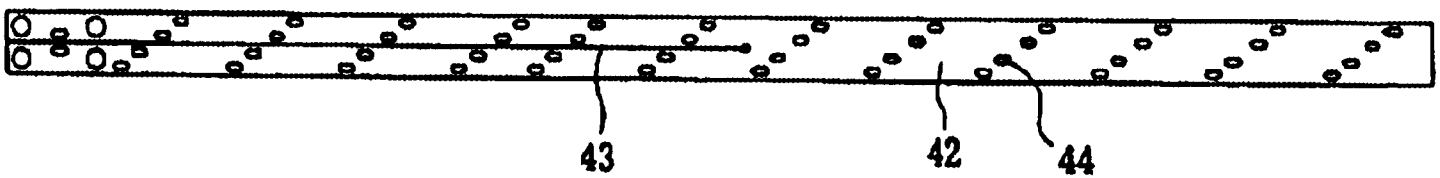
Figure 5A:
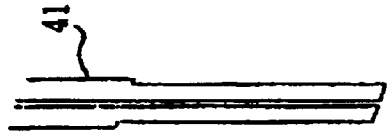
FIGS. 5(*a*)–(*e*) are views successively illustrating respective layers from the front side to the back side in the antenna unit to which the unwoven fabric is applied.
Figure 5B:
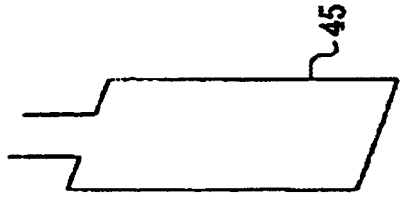
Figure 5C:
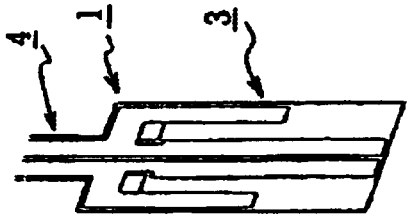
Figure 5D:
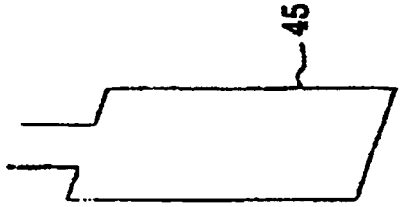
Figure 5E:
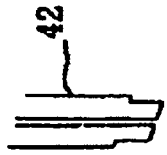

Now, a preferred example of the antenna unit according to the present invention will be described. In an example it is constructed by applying a metal plated unwoven or woven fabric to one or both surfaces of the portions of the antenna unit 1 other than the functional parts of antenna 3 to prevent an unnecessary electromagnetic wave. Other than the metal plated unwoven or woven fabric, Kevlar (trade name) or a stainless steel mesh may be used. FIGS. 3(*a*) and (*b*), respectively, show an example of unwoven fabric provided on the front and back surfaces of in the end opposite to the end provided with the antenna 3 and the ground 11 in the connection cable 4 on the insulating film 2.

In the examples shown in FIGS. 3(*a*) and (*b*), both the metal plated unwoven fabric 41 on the back surface (FIG. 3(*a*)) and the metal plated unwoven fabric 42 on the front surface (FIG. 3(*b*)) are formed on the antenna unit 1 through the insulating film along the central portions in a longitudinal direction of the antenna unit 1 shown in FIG. 1. Each of the unwoven fabrics 41 and 42 has a notch 43 corresponding to the notch 5 of the antenna unit 1 of FIG. 1. In addition, each of the unwoven fabrics 41 and 42 has a plurality of blind holes 44 on its main surface. Each of the unwoven fabrics 41 and 42 is constructed by pouring and curing a conductive adhesive into the blind holes 44 in the extension 21 of the ground 11 connected to the ground in the connection cable 4 and the extension 22 of the radio wave resonator 12.

The blind holes 44 is provided in advance so as not to contact the extension 24 of the signal line 14. Therefore the extension 24 of the signal line 14 in the connection cable 4 electrically shielded from the extension 21 of the ground 11 and the extension 22 of the radio wave resonator 12 on its both sides, and the unwoven fabrics 41 and 42 on the front and back surfaces. Thus, the connection cable 4 has the same functions as a conventional coaxial cable. FIGS. 4(*a*) and (*b*) respectively show an example having unwoven fabrics 41 and 42 shown in FIGS. 3(*a*) and (*b*) applied to the antenna unit 1 shown in FIG. 1, FIG. 4(*a*) showing the front surface and FIG. 4(*b*) showing the back surface. The pattern of the antenna 3 can be also seen in the back surface in FIG. 4(*b*), because the insulating film 2 and its underlying insulating protective layer are substantially transparent.

FIGS. 5(*a*)–(*e*) successively show respective layers from the backside to the front side in the antenna unit having the unwoven fabrics applied thereto. The examples shown in FIGS. 5(*a*)–(*e*) mainly show parts of the antenna 3, FIG. 5(*a*) showing the metal plated unwoven fabric 41, FIG. 5(*b*) showing the insulating protective layer 45, FIG. 5(*c*) showing the antenna unit 1 formed with the antenna 4 on the insulating film 2 and the conductive pattern in the connection cable 4, FIG. 5 (d) showing the insulating protective layer 45, and FIG. 5(*e*) showing the metal plated unwoven fabric 42. The antenna unit 1 can be obtained by laminating those layers shown in FIGS. 5(*a*)–(*e*) through the blind holes 44 provided in the unwoven fabrics 41 and 42 by the conductive adhesive.

Figures 6A, 6B, 6C:
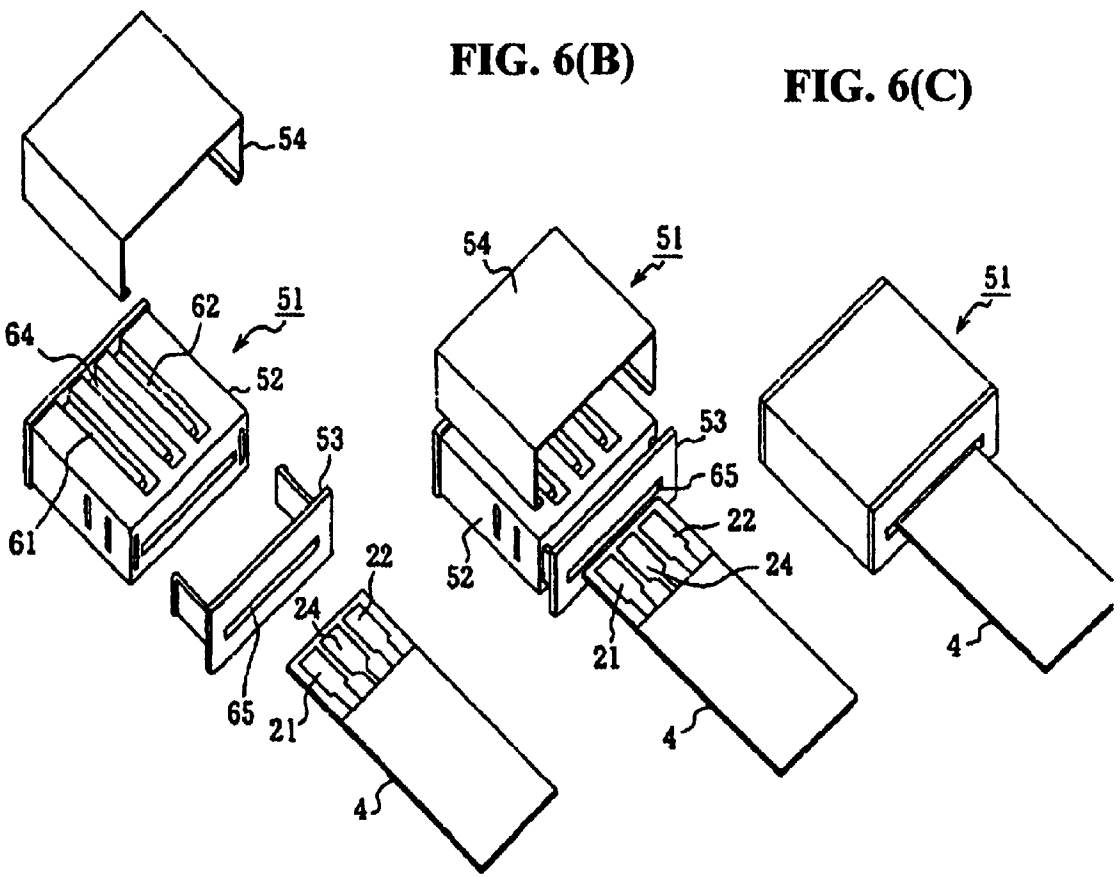
FIGS. 6(*a*)–(*c*) are views illustrating a method connecting for the antenna unit 1 according to the present invention to the connector.

FIGS. 6(*a*)–(*c*) respectively show an example of a connection method for the antenna unit 1 and the connector. In the examples shown in FIGS. 6(*a*)–(*c*), the connector 51 provided in a notebook PC or the like is made up of a connector body 52 having electrodes 61, 62 and 64, a front cover 53 having a slot 65 and a protective cover 54 covering the electrodes 61, 62 and 64. As shown in FIGS. 6(*a*)–(*c*), the antenna unit 1 is connected to the connector 51 by inserting the terminals 21, 22 and 24 provided on the insulating film 2 at one end of the connection cable 4 directly through the slot 65 and electronically connecting the terminals 21, 22 and 24 respectively to the electrodes 61, 62 or 64.

Figure 7:
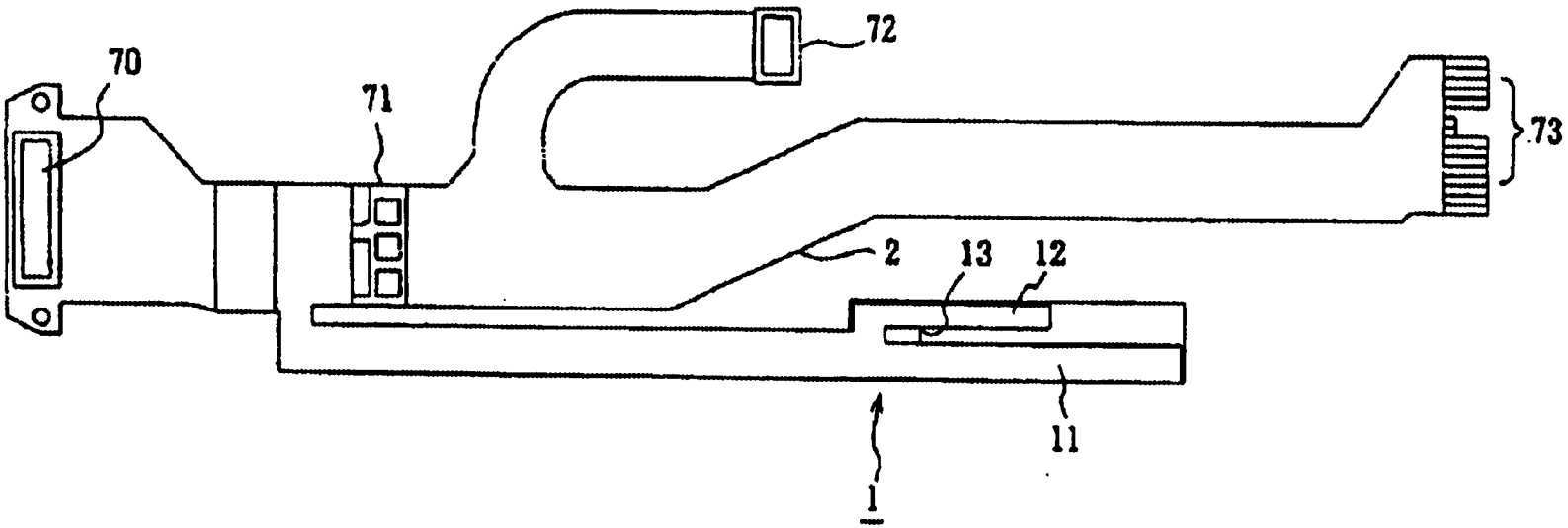
FIG. 7 is a view illustrating an example of the antenna unit according to the present invention and electric functioned components of the antenna formed integrally.

FIG. 7 shows an example of the antenna unit according to the present invention formed integrally with various electrical components of the antenna. In the example shown in FIG. 7, in addition to antenna 1, connectors 72, 73 and 74 are provided at locations which are integrally related by an LED interface (including a cable) 71. Various electrical components could also be integrally provided in addition to the LED interface 71, such as an inverter cable (including the cable), a keyboard light (including the cable) and a Bluetooth module (including the cable), as well as a filter chip, an IC and the like. In addition to connectors 72, 73 and 74 as previously discussed, a single edge type connector that directly fits in a terminal, for instance, or a card edge type connector, for example, may also be used.

Figures 8A, 8B, 8C, 8D, 8E, 8F, 8G, 8H:
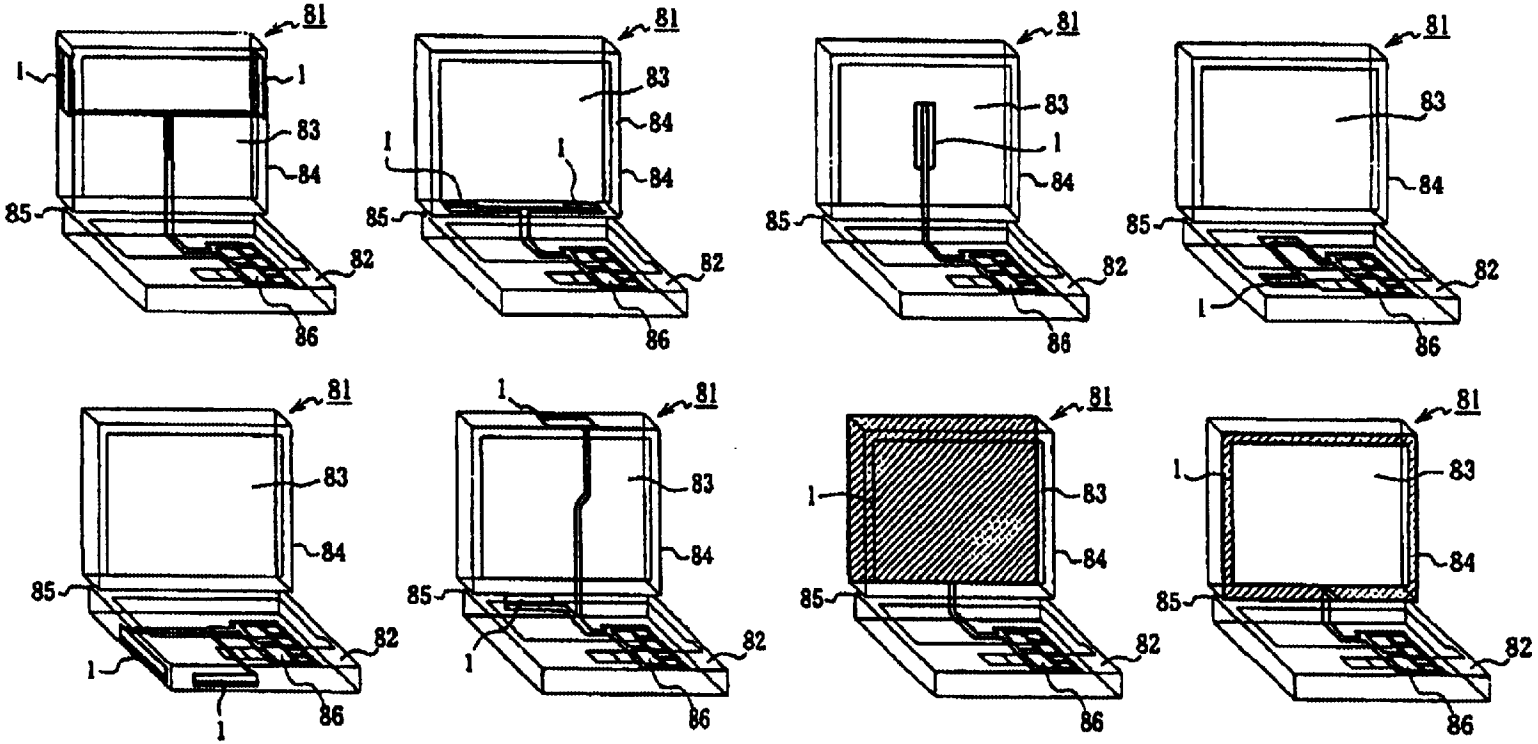
FIGS. 8(*a*)–(*h*) are views illustrating an example of an arrangement of the antenna unit according to the present invention mounted on a notebook PC.

Since the antenna unit 1 according to the present invention is formed integrally with the module of electric components, using the FPC technique as described above, the antenna itself and the connection cable can be freely bent or folded, resulting in higher freedom in their positioning. FIGS. 8(*a*)–(*h*) respectively show an example of an arrangement in which the antenna unit according to the present invention is mounted on a notebook PC. In the examples shown in FIGS. 8(*a*)–(*h*), the notebook PC 81 comprises a body 82 with an operational section, a cover 84 with a display 83 and covering the body 82 in its closed position and a hinge member 85 interconnecting the body 82 and the cover 84 so that the cover 84 may slide between its closed position and its open position. Moreover, in the examples shown in FIGS. 8(*a*)–(*h*), the body 82 and the cover 84 are shown in a perspective view so that the positions of the antenna unit 1 and the module 86 can be seen.

In an example shown in FIG. 8(*a*), two antenna units 1 are provided in the upper portions on both sides of the cover 84, and the module 86 is provided on the body 82. In an example shown in FIG. 8(*b*), two antenna units 1 are provided in the lower end on both sides of the cover 84, and the module 86 is provided on the body 82. In an example shown in FIG. 8(*c*), one antenna unit 1 is provided near the center of the cover 84, and the module 86 is provided on the body 82. In an example shown in FIG. 8(*d*), one antenna unit 1 and the module 86 are provided on the body 82. In an example shown in FIG. 8(*e*), both two antenna units 1 and the module 86 are provided on the body 82. In an example shown in FIG. 8(*f*), one of two antenna units 1 is provided on an upper portion of the cover 84, the other is provided on the body 82, and the module 86 is provided on the body 82. In an example shown in FIG. 8(*g*), one antenna unit 1 is provided on a whole side of the cover 84, and the module 86 is provided on the body 82. In an example shown in FIG. 8(*h*), one antenna unit 1 is provided on the periphery of the cover 84, and module 86 is provided on the body 82. As described above, the antenna unit 1 according to the present invention has high freedom for its positioning.

While, in the examples shown in FIGS. 8(*a*)–(*h*), the examples show the antenna unit 1 according to the present invention mounted on the notebook PC 81 to support the wireless LAN or Bluetooth, it is needless to say that use of the antenna unit 1 according to the present invention is not limited to the notebook PC 81. For example, it can be applied to other equipment which may make communication such as a portable telephone, a home electronic appliance and an automobile.

Figure 9:
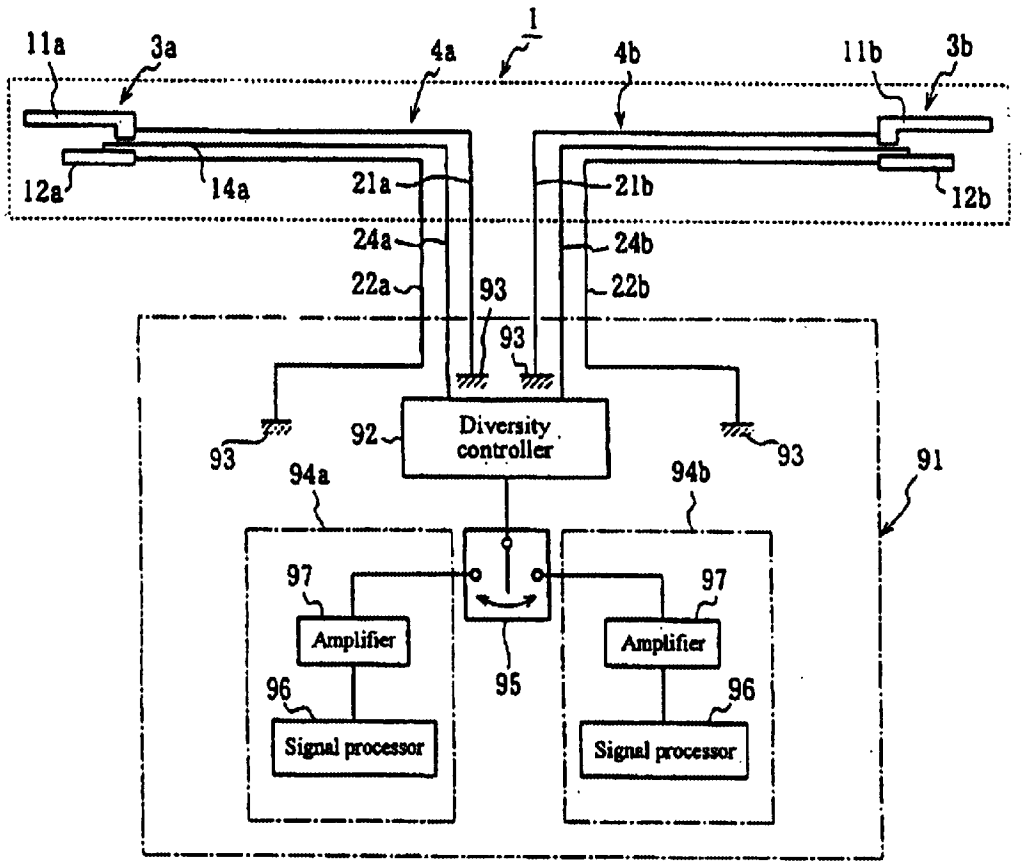
FIG. 9 is a block diagram illustrating an example of an antenna unit according to the present invention having two antennas used as a diversity antenna.

Now, an example of the antenna unit according to the present invention actually mounted on a transceiver will be described. FIG. 9 is a block diagram illustrating an example of the antenna unit 1 having two antennas used as a diversity antenna. In the example shown in FIG. 9, electric equipment with a PC card 91 comprises inverted "F" antennas 3*a* and 3*b* of the same structure as the inverted "F" antenna shown in FIGS. 1 and 2. These inverted "F" antennas 3*a* and 3*b* are positioned in different locations in the electric equipment on which they are mounted. The inverted "F" antennas 3*a* and 3*b* are connected to the PC card 91 through connection cables 4*a* and 4*b*. In the connection cables 4*a* and 4*b*, extensions 24*a* and 24*b* of the signal lines 14*a* and 14*b* are connected to a diversity controller 92 in the PC card 91, and extensions 21*a* and 21*b*, and 22*a* and 22*b* of respective grounds 11*a* and 11*b*, and radio wave resonators 12*a* and 12*b* are connected to a ground 93 of the PC card 91.

The diversity controller 92 regularly detects which of two inverted "F" antennas 3*a* and 3*b* is better in sensitivity for reception and transmission, selects the inverted "F" antenna detected as to have a better from sensitivity for reception and transmission as an inverted "F" antenna to be used, and sends and receives the selected inverted "F" antenna and RF signals. First and second RF signal processors 94*a* and 94*b* are provided on the PC card 91 as corresponding to the frequencies of RF signals in first and second inverted "F" antennas respectively. A switch 95 connects the diversity controller 92 to the one corresponding presently used RF signal frequency of first and second RF signal processors 94*a* and 94*b*. Each of the first and second RF processors 94*a* and 94*b* has a signal processor 96 and an amplifier 97. The signal processor 96 convents an RF signal received as an electric wave in the inverted "F" antennas 3*a* and 3*b* to a predetermined signal, and generates an RF signal to be sent as an electric wave in the inverted "F" antennas 3*a* and 3*b*. The amplifier 97 amplifies an RF signal to be outputted by the signal processor 96 and supplies the amplified RF signal to the switch 95, amplifies an RF signal sent from the switch 95 and supplies the amplified RF signal to the signal processor 96.

In the drawings and specifications there has been set forth a preferred embodiment of the invention and, although specific terms are used, the description thus given uses terminology in a generic and descriptive sense only and not for purposes of limitation.

What is claimed is:

1. An antenna comprising:

an insulating film;

a first connection cable formed on said insulating film wherein the cable comprises a signal line coupled to a feed point of a first radio wave resonator;

said first radio wave resonator formed integrally with said first connection cable;

a ground circuit disposed on both sides of said signal line; and a shield material which shields one surface of said signal line and said ground circuit wherein the surface is a surface selected from the group consisting of an upper and a lower main surface of said signal line and said ground circuit.

2. The antenna of claim 1, wherein said shield material is a material selected from the group consisting of; a metal plated unwoven fabric, a metal powder deposited unwoven fabric, a metal foil applied unwoven fabric, and metal foil applied unwoven fabric.

3. The antenna of claim 1, wherein said shield material is a material selected from the group consisting of: a metal plated woven fabric, a metal powder deposited woven fabric, a metal foil applied woven fabric, and metal foil applied woven fabric.

4. The antenna of claim 1, further comprising;

a ground circuit disposed on both sides of said signal line; and a shield material which shields both an upper and a lower main surface of said signal line and said ground circuit.

5. The antenna of claim 4, wherein said shield material is a material selected from the group consisting of: a metal plated unwoven fabric, a metal powder deposited unwoven fabric, a metal foil applied unwoven fabric, and metal foil applied unwoven fabric.

6. The antenna of claim 4, wherein said shield material is a material selected from the group consisting of: a metal plated woven fabric, a metal powder deposited woven fabric, a metal foil applied woven fabric, and metal foil applied woven fabric.

7. The antenna of claim 1 wherein said insulating film is made of a flexible polyethylene selected from the group consisting of: PET (Polyethylene Telephthalate) and a flexible PEN (Polyethylene Naphthalate).

8. The antenna of claim 7 wherein said insulating film is 5–75 $\mu$m thick.

9. The antenna of claim 1, further comprising:

a second connection cable are formed on said insulating film; and a second radio wave resonator formed integrally with said second connection cable;

wherein a portion located between said first connection cable and said first radio wave resonator and said second connection cable and said second radio wave resonator is notched whereby the portion is bifurcated.

10. The antenna of claim 1, wherein an electric component of said first radio wave resonator is further integrally formed on said insulating film.

11. The antenna unit according to claim 1, wherein said first radio wave resonator is a structure supporting a plurality of frequencies.

12. Apparatus comprising:

a body having an operational section;

a cover having a display which covers said body at its closed position, wherein the cover contains a connection cable formed on an insulating film and a radio wave resonator formed integrally with the connection cable;

a hinge interconnecting said body and said cover so that said cover hingedly moves in relation to said body between its closed and open positions;

a first antenna and a first signal processor therefor;

a second antenna and a second signal processor therefor; wherein the radio wave resonator comprises the first and second antennae, and a selector which selects one of said first and second signal processors and couples the selected signal processor to a signal line connected to a feeding point of the radio wave resonator.

* * * * *